United States Patent [19]

Rose et al.

[11] 4,044,885

[45] Aug. 30, 1977

[54] METHOD AND APPARATUS FOR COUNTING AND LOADING ITEMS, PARTICULARLY COOKIES, INTO PACKAGES AND THE LIKE

[75] Inventors: Edward Rose, Skokie; Robert A. Roth, Chicago, both of Ill.

[73] Assignee: Peters Machinery Company, Chicago, Ill.

[21] Appl. No.: 702,012

[22] Filed: July 2, 1976

[51] Int. Cl.[2] ..... B65G 47/26

[52] U.S. Cl. ..... 198/419; 53/159; 198/424

[58] Field of Search ..... 198/419, 420, 424; 53/154, 159, 160, 164

[56] References Cited

U.S. PATENT DOCUMENTS

| | | | |
|---|---|---|---|
| 3,290,859 | 12/1966 | Talbot | 53/160 |
| 3,500,984 | 3/1970 | Talbot | 198/424 |
| 3,627,102 | 12/1971 | Talbot | 198/424 |

*Primary Examiner*—Evon C. Blunk
*Assistant Examiner*—Jeffrey V. Nase
*Attorney, Agent, or Firm*—Dominik, Knechtel, Godula & Demeur

[57] ABSTRACT

In accordance with the present invention, cookies are counted and grouped and are guided and ride along support rails of a drop gate. The support rails are moved to one side during a dwell in the travel of a transfer conveyor, in a manner such that a group of cookies from one row and another group of cookies from another row drop through drop chutes of a drop chute assembly into an accumulator at the lower portion of the drop chute assembly, in longitudinal alignment along the centerline of the machine. There are actually two such drop chute assemblies, and the remaining group of cookies from each of the two rows drop in the same manner into the accumulator at the lower portion of the second drop chute assembly. After the groups of cookies have dropped into the accumulators of the drop chute assemblies, the accumulators operate respectively to longitudinally advance the one group of cookies into substantially abutting longitudinal relationship with the other group of cookies. Accordingly, at this time, there is effectively one group of cookies in each of the respective accumulators, consisting of a combined group of cookies which may be, for example, a combined group of chocolate and vanilla flavor or colored cookies. After the four groups of cookies have been accumulated into two groups of cookies, as described above, each group is dropped out of the accumulators of the drop chute assemblies, into a drop chute of a discharge apparatus. Each of the two groups of cookies then are pushed from the discharge apparatus, in timed relationship, into the flights of a wrapping machine associated with the cookie machine, preparatory for wrapping in cellophane or similar wrapping film.

12 Claims, 18 Drawing Figures

METHOD AND APPARATUS FOR COUNTING AND LOADING ITEMS, PARTICULARLY COOKIES, INTO PACKAGES AND THE LIKE

FIELD OF THE INVENTION

This invention relates to an improved method and apparatus for counting and loading items, particularly cookies, into packages and the like. More particularly, it relates to improvements in such method and apparatus for accumulating and stacking such items, for end-seal wrapping thereof.

THE PRIOR ART

This invention functions in conjunction with and provides an improvement of similar apparatus disclosed in U.S. Pat. No. 2,993,453, dated July 25, 1961, which forms sandwiched cookies; U.S. Pat. No. 3,290,859, dated Dec. 13, 1966, which counts into groups the sandwiched cookies; U.S. Pat. No. 3,625,343, dated Dec. 7, 1971, which conveys the groups of sandwiched cookies for wrapping; U.S. Pat. No. 3,500,984, dated Mar. 17, 1970, which converges and feeds sandwiched cookies for wrapping; and U.S. Pat. No. 3,627,102, dated Dec. 14, 1971, which converges and feeds sandwiched cookies for wrapping, all of which, and including the present invention, are assigned to the same assignee.

More particularly, U.S. Pat. No. 2,993,453 discloses an apparatus or machine for forming sandwiched cookies, i.e., two cookies which are sandwiched together with a creme filler between them. In U.S. Pat. No. 3,290,859, there is disclosed a tray loader which functions in conjunction with such a sandwich machine to count the sandwiched cookies and to separate the cookies into groups and to automatically load the cookies into trays, boxes and other containers commonly used to package cookies.

Generally, in this latter patent, the sandwiched cookies are delivered to a separating and counting conveyor which conveys the cookies in rows and separates the cookies into uniformly counted groups of a pre-determined count.

The cookies are picked up from the counting conveyor by an intermittently driven transfer conveyor driven by an intermittent drive. The groups of cookies are guided and ride along support rails of a drop gate. The support rails are moved to one side during a dwell in the travel of the transfer conveyor out of supporting relation with respect to the cookies to accommodate the cookies to drop through the drop chute guiding the cookies to fall into trays and rows, two rows of cookies falling into each of two side-by-side trays during each dropping operation.

The trays are positioned beneath the drop chutes, by movable stops, arranged to retain the trays from movement along the tray conveyor during a cookie loading operation to space the trays of loaded cookies as discharged from the tray conveyor.

Where single row trays are loaded, the trays may travel along the conveyor in side-by-side relation, and where multiple row trays are loaded, the trays may travel along the conveyor to the drop chutes in end-to-end relation, depending upon the width and type of tray being loaded. Where multiple row trays, such as five row trays, are loaded, the advance end of the advance tray is stopped under an associated drop chute by a stop or positioner to accommodate two rows of cookies to drop into the tray. The tray is then advanced a distance of two rows of cookies, and two additional rows of cookies are dropped into the tray just behind the first two rows of cookies. During a third dropping operation, one row of cookies drops into the advance tray to fill the tray, while the next adjacent row of cookies drops into the advance end of the rearwardly disposed tray. Filling of the next adjacent rearward tray is then completed in two more dropping operations.

SUMMARY OF THE INVENTION

Contrary to the above-described loading operation, in accordance with the present invention, the cookies are counted and grouped in the same manner described, and are guided and ride along the support rails of a drop gate. The support rails are moved to one side during a dwell in the travel of the transfer conveyor, in a manner such that a group of cookies from one row and another group of cookies from another row drop through drop chutes of a drop chute assembly into an accumulator at the lower portion of the drop chute assembly, in longitudinal alignment along the centerline of the machine. There are actually two such drop chute assemblies, and the remaining group of cookies from each of the two rows drop in the same manner into the accumulator at the lower portion of the second drop chute assembly.

After the groups of cookies have dropped into the accumulators of the drop chute assemblies, the accumulators operate respectively to longitudinally advance the one group of cookies into substantially abutting longitudinal relationship with the other group of cookies. Accordingly, at this time, there is effectively one group of cookies in each of the respective accumulators, consisting of a combined group of cookies which may be, for example, a combined group of chocolate and vanilla flavor or colored cookies.

After the four groups of cookies have been accumulated into two groups of cookies, as described above, each group is dropped out of the accumulators of the drop chute assemblies, into a drop chute of a discharge apparatus. Each of the two groups of cookies then are pushed from the discharge apparatus, in timed relationship, into the flights of a wrapping machine associated with the cookie machine, preparatory for wrapping in cellophane or similar wrapping film.

Accordingly, it is the object of the present invention to provide improvements in the method and apparatus for counting and loading items, particularly cookies, into packages and the like.

More particularly, it is an object to provide improvements in such methods and apparatus for accumulating and stacking such items, for end-seal wrapping thereof.

Further objects, features and advantages of the invention will be readily apparent from the following description of certain preferred embodiments thereof, taken in conjunction with the accompanying drawings.

DESCRIPTION OF THE PREFERRED EMBODIMENT OF THE INVENTION

Figure 1:
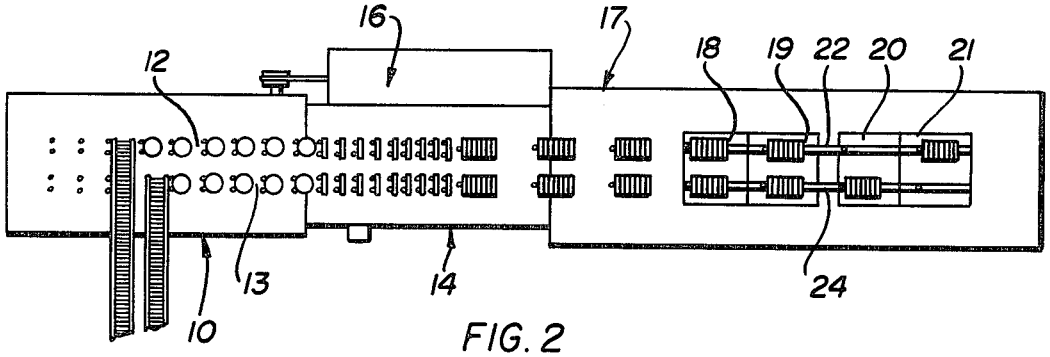
FIG. 1 is a schematic plan view diagammatically showing a cookie counting and loading apparatus in association with a sandwiching machine.

Referring now to the drawings, in FIG. 1 there is diagrammatically illustrated a sandwiching machine 10 having two conveyors 12 and 13 for conveying two rows of sandwiched cookies to a separating and counting conveyor 14. The latter separates the cookies into uniformly counted groups or stacks, in accordance with an established predetermined count which is variable.

The cookies are picked from the conveyor 14 by an intermittently driven transfer conveyor 17, driven by an intermittent drive 16, which provides a dwell in the travel of the transfer conveyor 17 to accommodate the cookies to drop through drop chutes 18–21 of the drop chute assemblies, into the accumulators thereof.

The groups or stacks of cookies picked up by the transfer conveyor 17 are guided and ride along a pair of drop gates or support rails 22 and 24. The drop gate support rails 22 and 24 are moved to one side out of supporting relation with respect to the cookies to accommodate the cookies to drop through the drop chutes 18-21, in a manner more fully described below, into the accumulators.

In this respect, the above-described apparatus can be of the type disclosed in U.S. Pat. No. 3,290,859 and reference may be made to the patent for a full and detailed description of the construction and operation of the same. The sandwiched cookies can be formed as described in U.S. Pat. No. 2,993,453. The sandwiched cookies delivered to the sandwiching machine 10 includes one row of chocolate color or flavor cookies and one row of vanilla color or flavor cookies and, for purposes of explaining the present invention, the chocolate cookies and the vanilla cookies can be assumed to be conveyed by the conveyors 12 and 13, respectively.

The purpose of the accumulators is to accumulate a stack of sandwiched cookies consisting of a predetermined count, with half of the stack consisting of chocolate cookies and half consisting of vanilla cookies. In the illustrated embodiment, the accumulated stack of cookies comprises 14 cookies, however, the count can be varied, as more fully described below. The accumulated stacks of cookies are delivered to an end-sealing wrapping machine for packaging, and the latter may be any one of a number or presently available commercial wrapping machines.

The operation of the drop chutes 18–21 and the accumulators in accumulating the stacks of cookies is generally illustrated in FIGS. 2–6, and may be briefly described as follows. During the course of operation of the intermittent conveyor 17, four groups of cookies are intermittently advanced, at the same time, and are disposed over the respective drop chutes 18–21.

Figure 2:
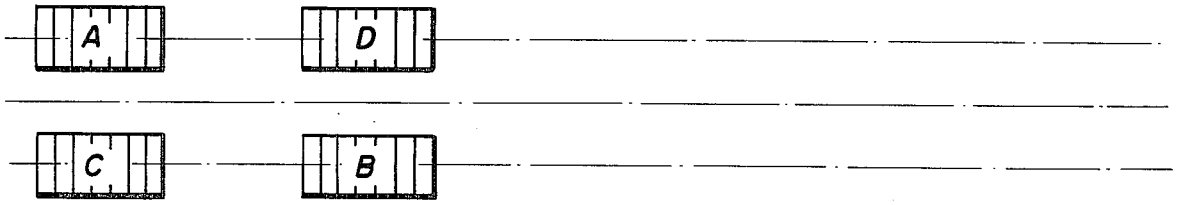
FIGS. 2–6 are diagrammatic views generally illustrating the manner in which the items, such as cookies, are dropped from the transfer conveyor into the accumulators of the drop chute assemblies and how the groups of cookies are accumulated and stacked, for end-seal wrapping thereof.

Initially, four groups of cookies are advanced and disposed over the drop chutes 18 and 19, as illustrated in FIG. 2. At this time during the drop cycle, the drop gates or support rails 22 and 24 are moved to one side out of supporting relation with respect to the groups of cookies, so that the groups of cookies labeled A and B are dropped, in the manner described in U.S. Pat. No. 3,290,859.

Figure 3:
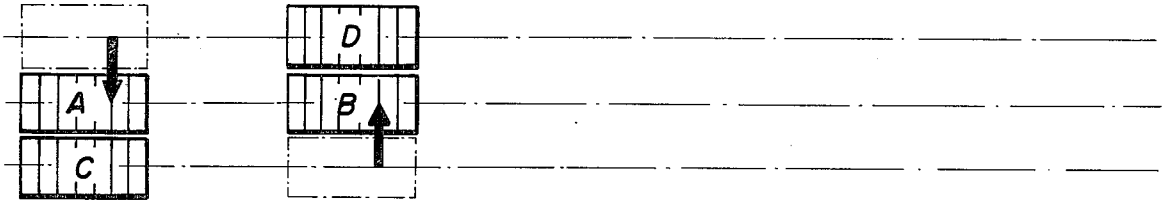

The groups of cookies A and B drop through the drop chutes 18 and 19 and are guided into the accumulator sections 25 and 26 (FIGS. 7–9) of the drop chute assembly 17. In falling out of the intermittent conveyor 17 through the drop chutes 18 and 19, the groups of cookies roll sideways to the centerline of the overall cookie machine, from the lane or row centers which are to each side of the machine center, as illustrated in FIG. 3.

Figure 4:
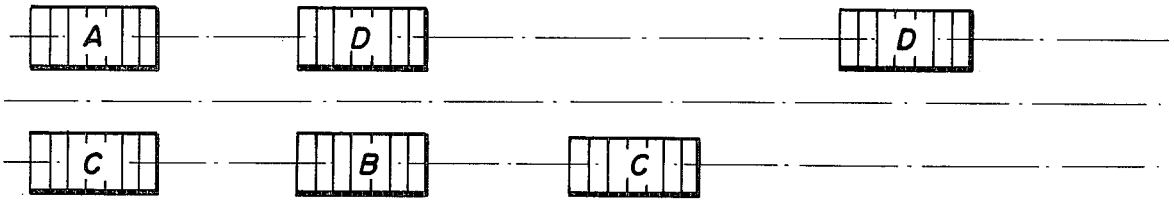

Now, ignoring for the moment the cookies which have dropped into the accumulator sections 25 and 26 of the drop chute assembly 27, the intermittent conveyor 17 operates to advance four more groups of cookies over the drop chutes 18 and 19, and the two groups of cookies C and D which were not dropped simultaneously with groups A and B are advanced over the drop chutes 20 and 21, respectively, as illustrated in FIG. 4 and as shown in FIG. 1.

Figure 5:
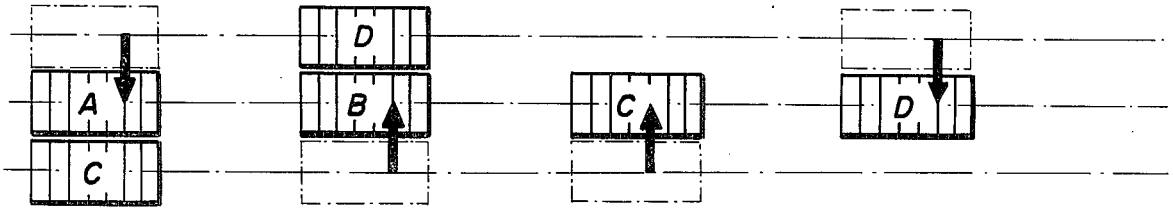

During the subsequent drop operation, the cookie group support rails 22 and 24 again are moved to one side out of supporting relation with respect to the cookies, so that the cookie groups A and B over the drop chutes 18 and 19 drop through them into the accumulator sections 25 and 26 of the drop chute assembly, as illustrated in FIG. 5. The two drop chute assemblies are identical in construction and operation, except that one is a mirror image of the other, since they are receiving cookies dropped from the opposite sides of the machine centerline. The four groups of cookies A–D now are disposed in spaced-apart relation, along the centerline of the machine, as illustrated in FIG. 5. The support rails 22 and 24 are divided so as to permit the groups of cookies to drop through the drop chutes 18–21 in this fashion, whereas the support rails disclosed in the subject patent are continuous rails. Otherwise, however, the construction and operation of the support rails are the same.

Figure 6:
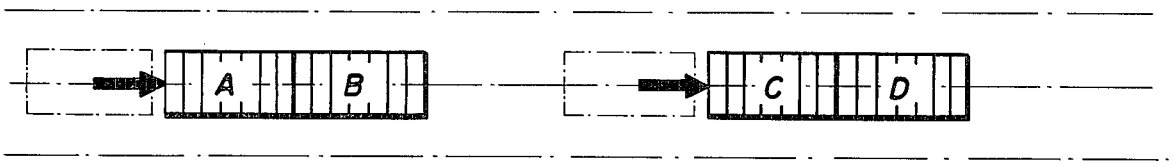

In the accumulators, the cookie groups A and C are forwardly longitudinally advanced into substantially abutting relation with the cookie groups B and D, respectively, as illustrated in FIG. 6, to form two stacks of cookies, each of which consists of half chocolate flavor and half vanilla flavor. Initially, the groups of cookies A and B which were dropped, as illustrated in FIG. 3, were stacked in the above manner and removed from the drop chute assembly 27, before the next two groups were dropped, as during the subsequent drop illustrated in FIG. 5.

After the groups of cookies are stacked into two stacks of cookies, as illustrated in FIG. 6, each of these stacks of cookies is dropped out of the accumulators into respective ones of a pair of discharge apparatus. The latter can be a discharge apparatus of the type disclosed in U.S. Pat. No. 3,627,102, which functions to discharge the stacks of cookies onto a wrapping machine conveyor in succession where they are conveyed in separated relation relative to each other and in line to a wrapping machine, for end-seal wrapping thereof. Reference may be made to this last-mentioned patent for a more detailed description of the construction and operation of the discharge apparatus.

Now that the operation of the apparatus of FIG. 1 and the drop chute assemblies and the accumulators associated therewith has been generally described, the construction of the drop chute assemblies can be more fully described as follows.

Figure 16:
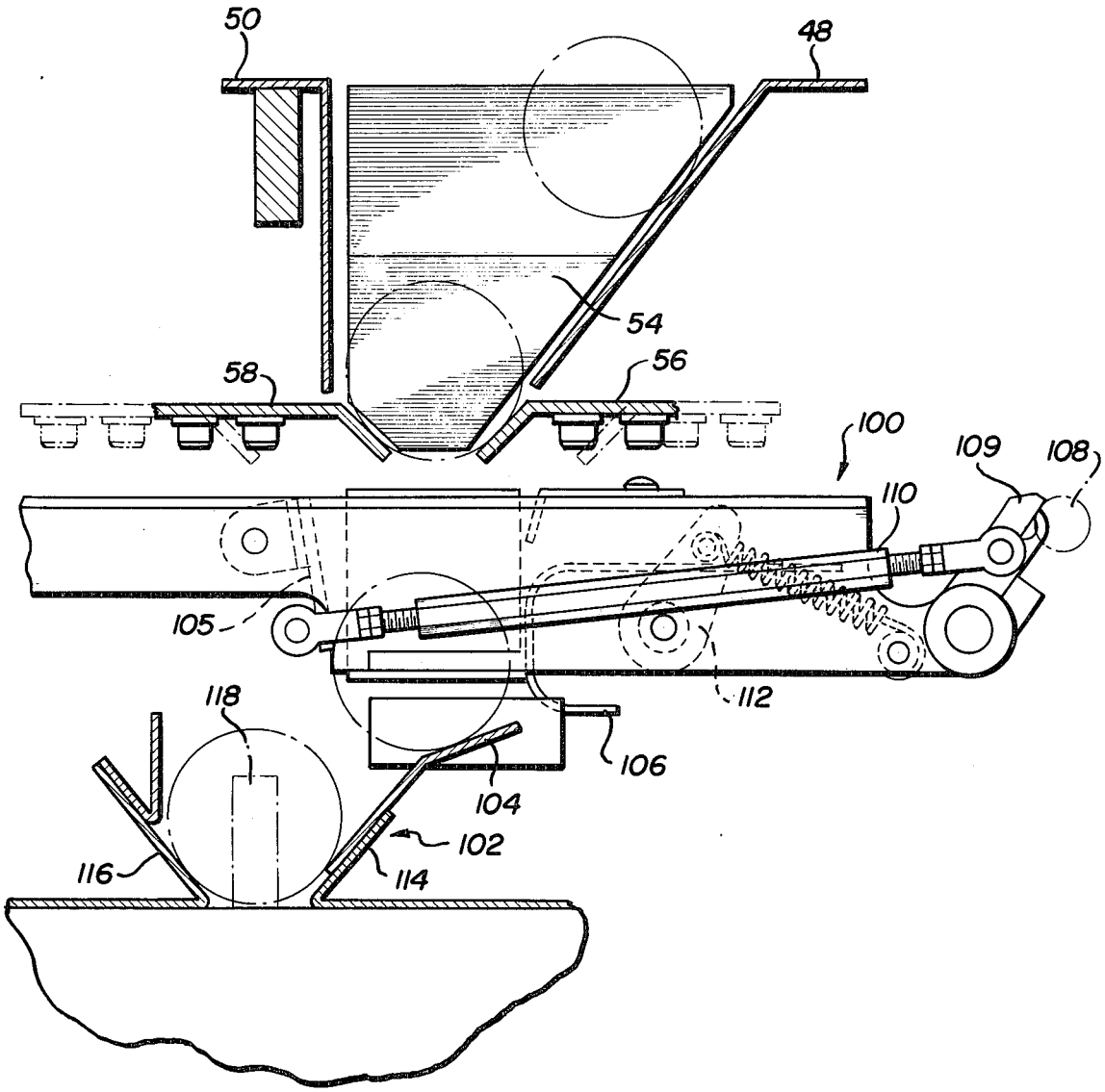
FIG. 16 is a fragmentary sectional view generally illustrating the discharge apparatus for discharging the items, such as cookies, onto the conveyor of wrapping machine.

As indicated above, there are two such drop chute assemblies, one of which includes the drop chutes 18 and 19, and the other one of which includes the drop chutes 20 and 21. Also, both of the drop chute assemblies function in the same manner and are of the same construction, except that the one is a mirror image of the other. Accordingly, only one of the drop chute assemblies is shown and described in detail. There also is a discharge apparatus 100, as illustrated in FIG. 16, associated with each of the drop chute assemblies, for receiving and discharging the stacks of cookies accumulated by the respective accumulators thereof.

Figure 7:
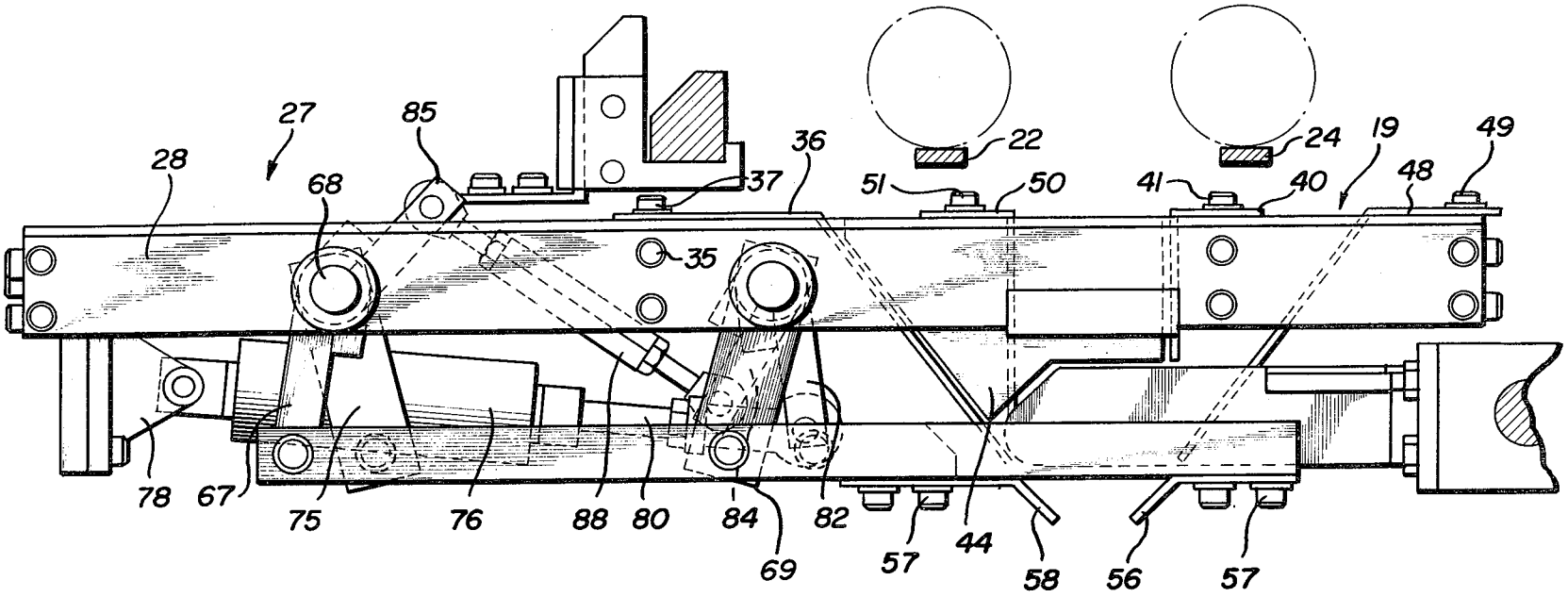
FIG. 7 is a fragmentary side view of the apparatus of FIG. 1, and particularly the accumulator thereof.
Figure 8:
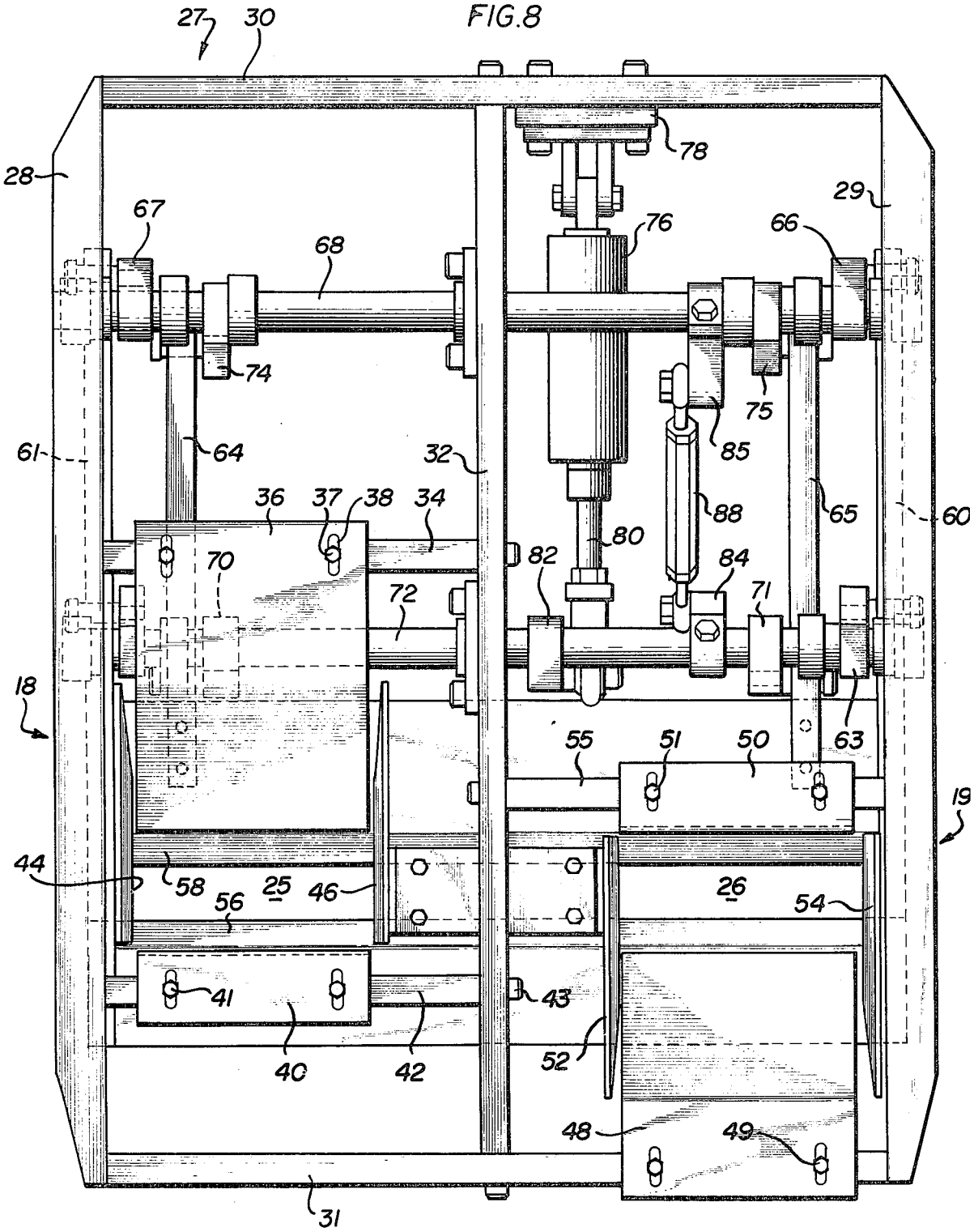
FIG. 8 is a top-plan view of one of the two drop chute assemblies.
Figure 9:
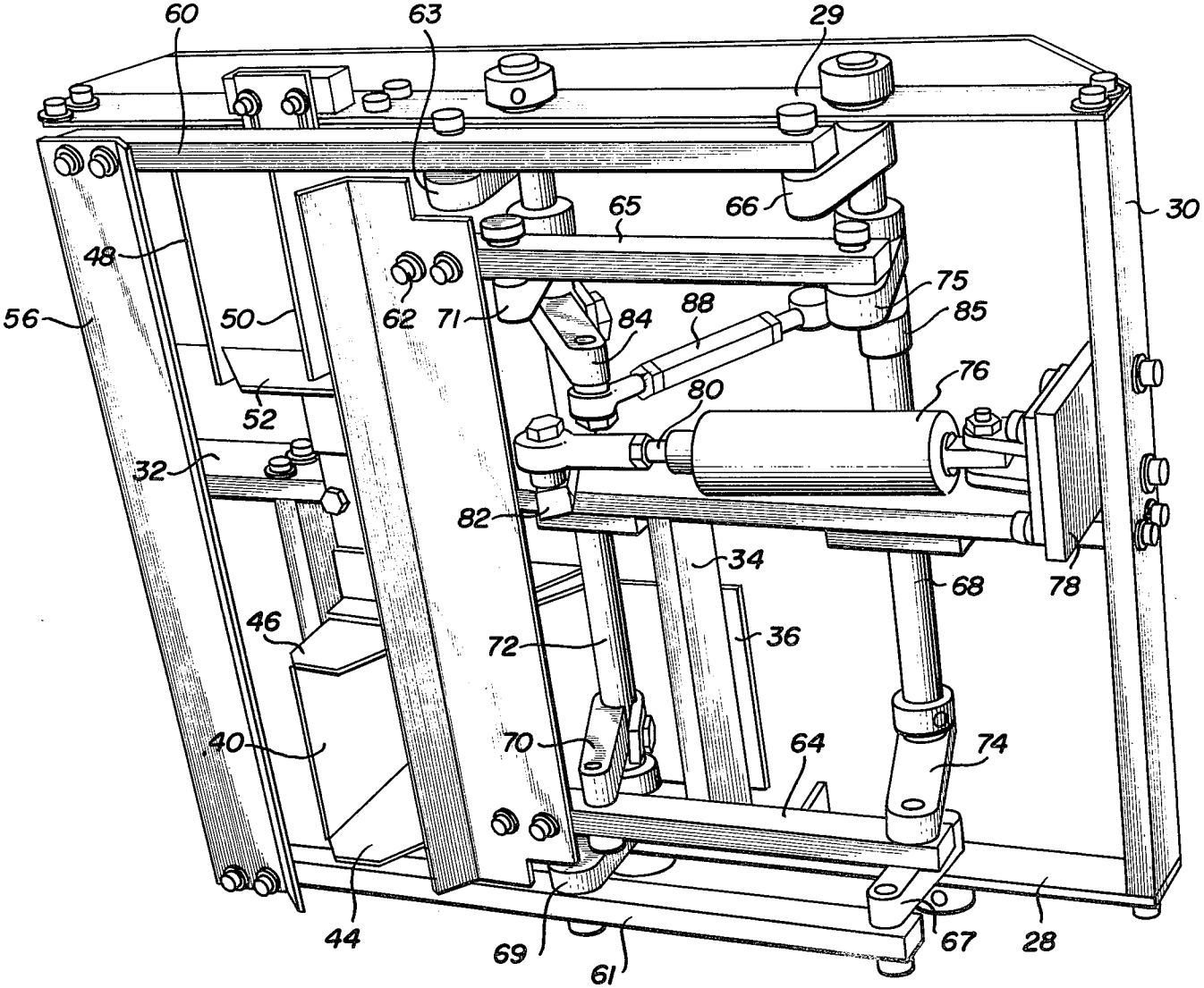
FIG. 9 is a bottom perspective view of one of the two drop chute assemblies.

Referring now to FIGS. 7–9, it can be seen that the groups of cookies ride on the drop gate support rails 22 and 24 and, during the drop operation described above, the groups of cookies drop through the drop chutes 18 and 19, or 20 and 21 into the accumulator sections 25 and 26 (FIG. 8) of the respective ones of the drop chute assemblies. The two drop chute assemblies 27 are constructed for a plug-in type operation, the same being easily removable for cleaning and for substitution with different size units to accommodate different groups of cookies of predetermined counts.

The drop chute assemblies 27 are of a generally box-like construction having side frame members 28 and 29, end frame members 30 and 31 and a central divider member 32. A support brace 34 is affixed by means of screws 35 or the like between the side frame member 28 and the central divider member 32, and this support brace 34 has affixed to it a sloped guide plate 36 which effectively forms one wall of the drop chute 18. The guide plate 36 is a flat plate of sheet metal which is angularly bent so as to provide a flat end portion and a downwardly sloped portion. Elongated slots 38 are provided in the flat end portion for receiving threaded bolts 37, for adjustably securing the sloped guide plate 36 to the support brace 34. An L-shaped guide plate 40 is similarly adjustably affixed by means of threaded bolts 41 to another support brace 42 secured by means of threaded bolts 43 between the side frame member 28 and the central divider member 32. The one leg of this L-shaped guide plate 40 forms another wall of the drop chute 18.

The drop chute 18 is further formed by means of two end walls 44 and 46 which are adjustably secured to the side frame member 28 and to the central divider member 32, respectively.

The drop chute 19 is of a similar construction having a sloped guide wall 48, an L-shaped guide wall 50 and two end walls 52 and 54. However, since the groups of cookies are dropped from the two rows which are on the opposite sides of the machine centerline, the sloped guide wall 48 and the L-shaped guide wall 50 are reversed in position, from the sloped guide wall 36 and the L-shaped guide wall 40. In this case, the sloped guide wall 48 is adjustably affixed by means of threaded bolts 49 to the end frame members 31, and the L-shaped guide wall is adjustably affixed by means of threaded bolts 51 to a support brace 55 secured between the side frame member 29 and the central divider member 32.

A pair of drop rails 56 and 58 (FIG. 9) are disposed beneath the accumulator sections 25 and 26, and effectively form the bottom walls thereof, for supporting the groups or cookies therein. Accordingly, as the groups of cookies, e.g., the cookie groups A and B, drop through the drop chutes 18 and 19, as described above, the cookies engage the sloped guide walls 36 and 48 and are guided or rolled by them into the accumulator sections 25 and 26 where they seat on the drop rails 56 and 58. In doing so, the groups of cookies are longitudinally aligned with respect to one another, and along the machine centerline. The spacing between the end walls 44 and 46, and 52 and 54, is proportioned such that the cookies are retained in a vertically aligned stacked relationship with respect to one another.

As can be best seen in FIG. 9, the drop rail 56 extends across substantially the entire width of the accumulator, and one end thereof is secured by means of threaded bolts 57 to one end of a lever arm 60. The opposite end thereof is secured to a lever arm 61. These lever arms 60 and 61 extend longitudinally of the accumulator, and the opposite ends thereof are coupled to pivot arms 66 and 67, respectively. The pivot arms 66 and 67 are, in turn, coupled to a shaft 68 which extends transversely of the accumulator and is journaled for rotation to the side frame members 28 and 29. A pivot arm 63 is coupled for rotation to a shaft 72 which extends transversely of the accumulator and is journaled for rotation to the side frame members 28 and 29, and the end of this pivot arm 63 is coupled to the lever arm 60, at substantially a mid-point along its length. A pivot arm 69 is correspondingly coupled to the shaft 72 and to the lever arm 61.

The drop rail 58 is affixed in a similar to a pair of lever arms 64 and 65. One end of the lever arm 64 is coupled to a pivot arm 74 which is coupled for rotation about the shaft 68, and a pivot arm 70, which is fixedly coupled to the shaft 72 for rotation with it, is coupled to the lever arm 64 in spaced relation with the pivot arm 74. The lever arm 65 is connected in a like fashion to a pivot arm 75 which is coupled for rotation about the shaft 68, and to a pivot arm 71 fixedly coupled to the shaft 68 for rotation with it.

A pneumatic cylinder 76 having a piston 80 is connected by means of a bracket assembly 78 to the end frame member 30. Its piston 80 is coupled to a pivot arm 82 which is fixedly coupled to the shaft 72. A linkage arm 88 is coupled between a pair of pivot arms 84 and 85 which are fixedly secured to the shaft 72 and to the shaft 68, respectively.

With the above-described assemblage supporting the drop rails 56 and 58, when the pneumatic cylinder is operated to extend or retract its piston 80, the drop rails 56 and 58 are closed to support the cookies in the accumulator sections 25 and 26, and are opened to permit or cause the cookies to drop through or out of the accumulator sections 25 and 26, respectively.

More particularly, when the piston 80 is extended, the pivot arm 82 is pivotally rotated clockwise and, in turn, causes the shaft 72 to also rotate in the same direction. The pivot arms 70 and 71 coupled to the shaft 72 rotate clockwise, which action causes the lever arms 64 and 65, and hence, the drop rail 58, to move to the left, as seen in FIG. 9. The pivot arms 74 and 75 support the ends of the lever arms 64 and 65, and merely rotate on the shaft 68.

The pivot arm 84, being affixed to the shaft 72, is pivotally rotated clockwise, and the linkage arm 88 coupled to it, in turn, causes the pivot arm 85, and hence the shaft 68 to which it is affixed, to rotate counter-clockwise. The pivot arms 66 and 67 being affixed to the shaft are caused to rotate counter-clockwise, and the lever arms 60 and 61 coupled to them, as well as the drop rail 56, move to the right, as seen in FIG. 9. The pivot arms 63 and 69 support the lever arms 60 and 61, and merely pivotally rotate on the shaft 72.

Accordingly, when the piston 80 is extended, the drop rails 56 and 58 are in their closed position, supporting the cookies in the drop chutes 18 and 19. Conversely, when the piston 80 is retracted, the movement of the above-described linkage is reversed, and the drop rails 56 and 58 are moved to their open position, permitting the cookies to drop out of the drop chutes 18 and 19.

As indicated above, before the cookies are dropped out of the drop chutes, the two groups of cookies in each of the accumulators are combined into one group or stack of cookies. These groups of cookies are combined by means of the accumulator shuttle assembly shown in FIGS. 10–12. Generally, the cookies are stacked by advancing the group of cookies in the accumulator section 25 longitudinally forward into substantially abutting relationship with the group of cookies in the accumulator section 26.

Figure 10:
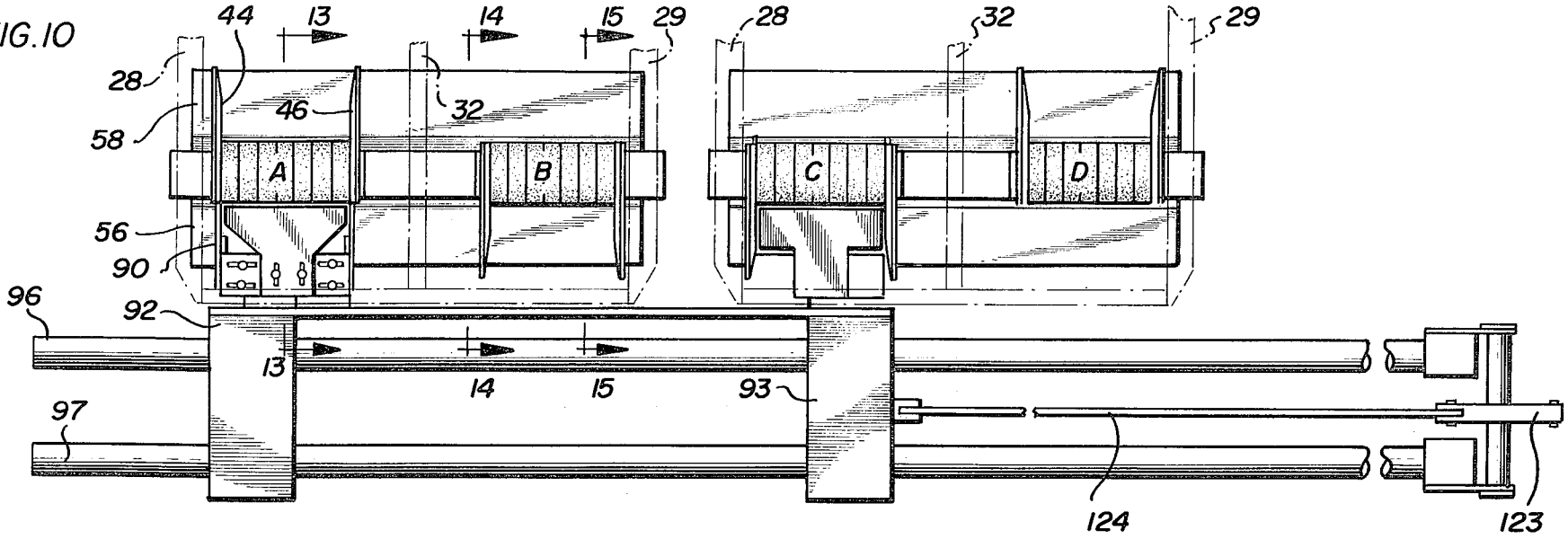
FIG. 10 is a fragmentary bottom plan view of the advancing mechanism in its initial position.
Figure 12:
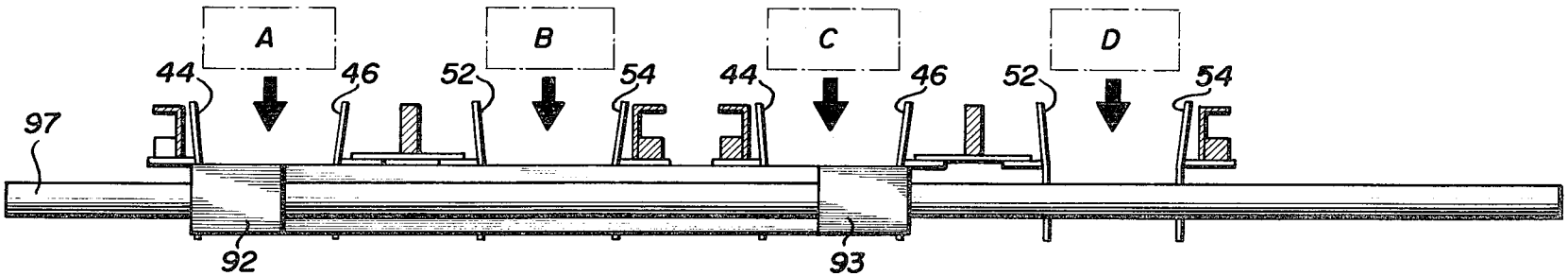
FIG. 12 is a fragmentary side elevation view of the advancing mechanism of FIGS. 10 and 11.
Figures 11, 18:
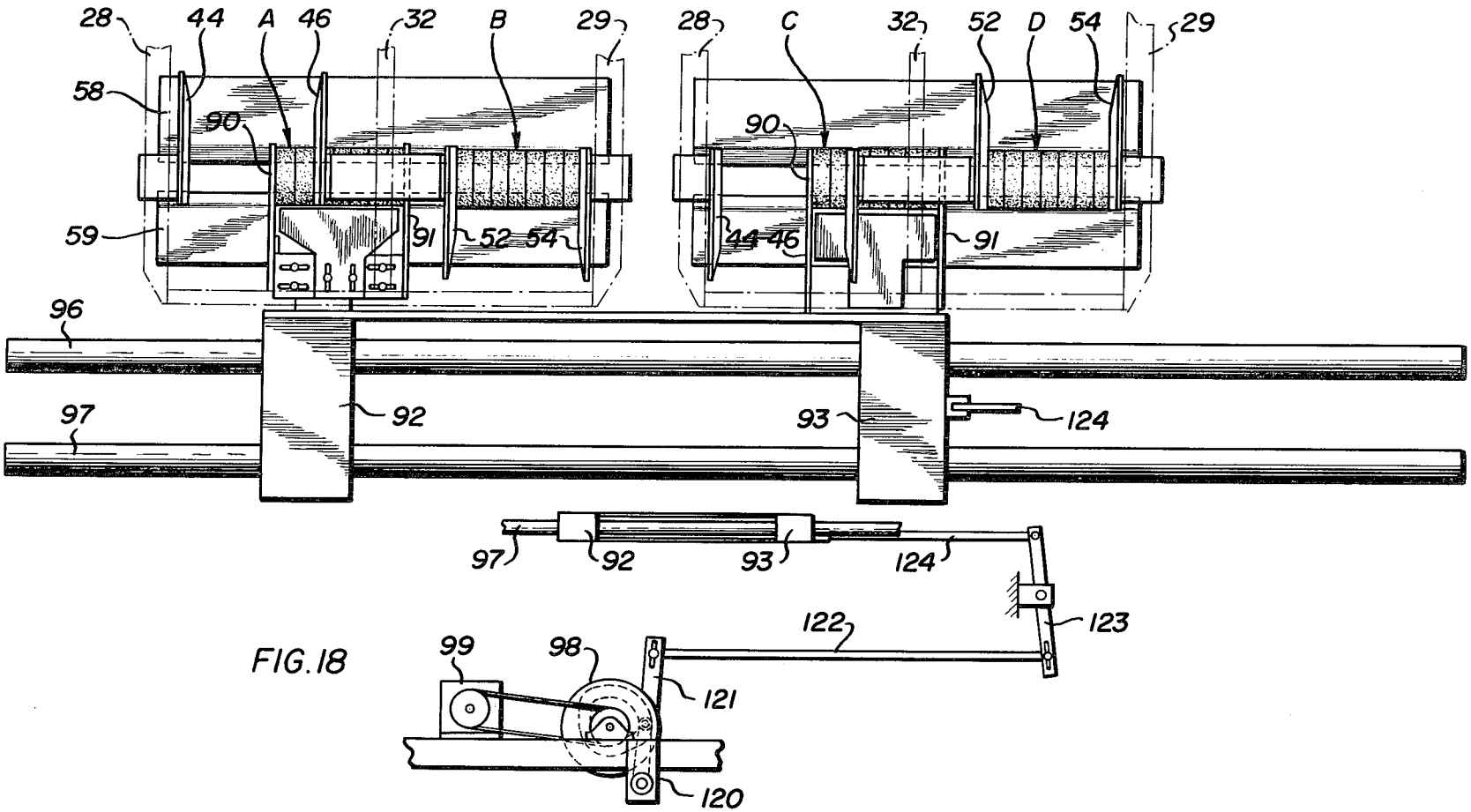
FIG. 11 is a fragmentary bottom plan view of the advancing mechanism of FIG. 10, generally illustrating the latter in an intermediate advancing position.
FIG. 18 is a partial fragmentary side view of the gear box and box cam for imparting timed reciprocating motion to the advancing mechanism.

More particularly, in FIGS. 10–12, the drop chute assemblies are only partially diagrammatically illustrated, with only the side frame members 28 and 29 and the side walls 44, 46, 52 and 54 of the drop chutes thereof being shown in operative relationship with the accumulator shuttle assembly.

The accumulator shuttle assembly includes a pair of slide rods 96 and 97 which are disposed in parallel, spaced-apart relation, and upon which are slidably affixed a pair of slide blocks 92 and 93. These slide blocks 92 and 93 each have affixed to them a pair of pusher plates 90 and 91 which are disposed in spaced-apart relation a distance corresponding to the distance between the side walls 44 and 46 of the drop chutes 18, so as to receive the groups of cookies in these drop chutes between them. Also affixed to each of the slide blocks 92 and 93 is an L-shaped end wall guide 94 which, as can be best seen in FIG. 13, has its one wall disposed in vertical alignment with and below the one wall of the L-shaped guide plate 40.

Figure 13:
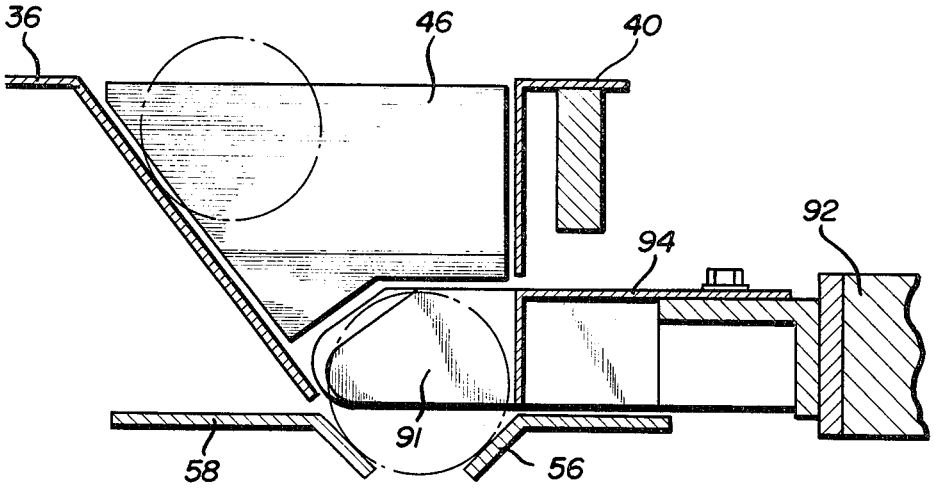
FIG. 13 is a sectional view taken generally along lines 13—13 of FIG. 10.
Figure 14:
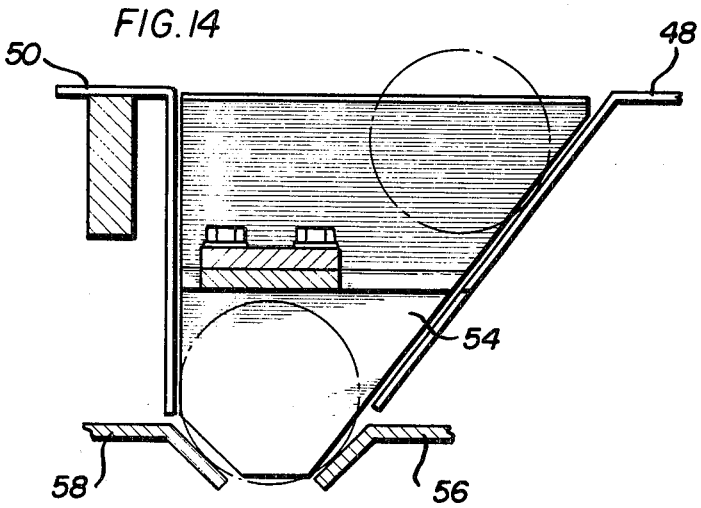
FIG. 14 is a sectional view taken generally along lines 14—14 of FIG. 10.
Figure 15:
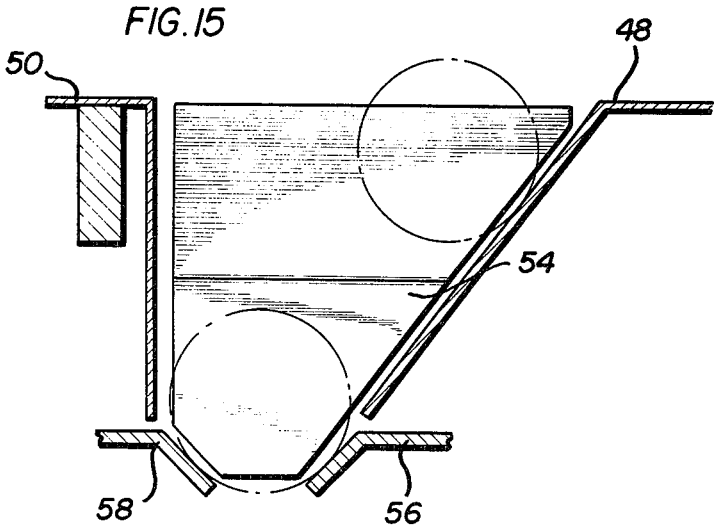
FIG. 15 is a sectional view taken generally along lines 15—15 of FIG. 10.

The pusher plates 90 and 91, as can be best seen in FIG. 13, are generally in the form of blades extending into the accumulator section 25. These pusher plates 90 and 91 are proportioned to effectively form a vertical extension of the respective side walls 44 and 46 which are formed to permit the pusher plates 90 and 91 to move laterally with respect to them, within the accumulator, as more fully described below.

With reference to FIGS. 11 and 18, it can be seen that the time reciprocating motion of the accumulator shuttle assembly is imparted to it by a box cam 98 which is driven by a miter gear box 99, both of which may be of the type disclosed and described in the above-mentioned U.S. Pat. No. 3,290,859. The box cam 98 is driven so as to make one revolution per cycle, a cycle being equal to four groups of cookies being advanced into the drop position with respect to the drop chutes 18–21. The rotating box cam 98 operates the sliding, reciprocating slide blocks 92 and 93 via linkage arms 121–124 coupled to the slide blocks 93.

In operation, the groups of cookies, A, B, C and D drop into the accumulator sections 25 and 26, in the manner described above. Within the accumulator section 25, the cookie groups A and C are confined therein by the side wall 94, and by the pusher plates 90 and 91. Within the accumulator section 26, the cookie groups B and D are confined therein by the end walls 52 and 54.

Figure 17:
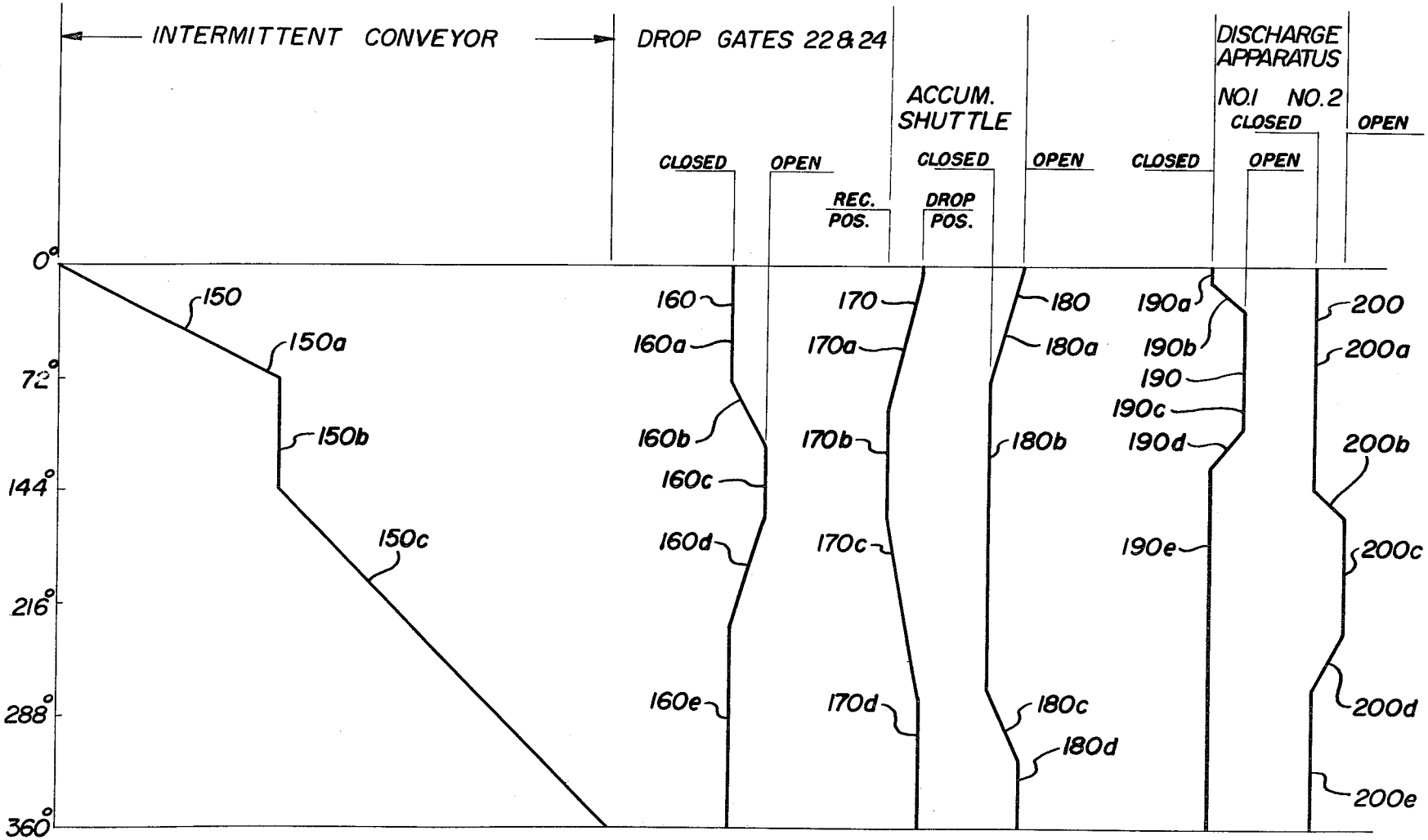
FIG. 17 is a timing chart generally illustrating the timed relationship between the operations of the accumulator and the discharge apparatus.

During the time sequence of operations, as illustrated on the timing chart shown in FIG. 17, the accumulator shuttle assembly is operated by the box cam 98 and the linkage arms 121–124 to longitudinally advance the slide blocks 92 and 93 (to the right as seen in FIGS. 10-12). The pusher plates 90 and 91 affixed to the slide blocks 92 and 93 are advanced and, in turn, advance the cookie groups A and C, as can be seen in FIG. 11, wherein the cookie groups are shown in an intermediate advanced position. The motion is such that the pusher plates 91 move into an almost abutting relationship with the side walls 52 of the accumulator section 26, so that the cookie groups A and B, and C and D are effectively separated by only the thickness of the pusher plate 91 and the side wall 52.

At this time, during the time sequence of operations, the pneumatic cylinders 76 are operated to retract their pistons 80. This action, as described above, opens the drop gates 56 and 58 and thus the four groups of cookies which now have been combined into two stacks of cookies drop out of the accumulators into a discharge apparatus 100 associated with the respective ones of the accumulators, as generally illustrated in FIG. 16.

The accumulator shuttle then is longitudinally reciprocally operated, to its initial position, in readiness for the next drop operation.

To compensate for the different lengths of actuating strokes necessary for the different horizontal longitudinal lengths of strokes of the accumulator shuttle, the cam arm 120 is slotted. Also, the cam arm 121 is slotted so that, by adjustment of the pivot points on the cam arm 121 and the lever arm 123, the distance of travel can be varied, to give the proper accumulating positions.

The discharge apparatus 100, as indicated above, may be of the type disclosed in U.S. Pat. No. 3,627,102, and reference may be made to this patent for a more detailed description of the construction and operation thereof. Generally, however, the discharge apparatus each includes a sloped support guide plate 104, a slide gate 105 and an ejector plunger 106 which together form a drop gate for receiving the stacks of cookies, and from which the stacks of cookies are discharged onto a wrapping machine conveyor 102, between the flights 118 thereof. A linkage arm 110 is coupled between the side gate 105, and a pivotal cam member 109 which is operated by a cam roller 108. The pivotal cam member 109 also operates a pivotal lever arm 112, and an ejector plunger 106 associated with it.

In operation, the cam roller 108 in timed relationship with the wrapping machine conveyor 102 operates the lever arm 112 and the linkage arm 110 which, in turn, simultaneously pivotally opens the side gate 105 and causes the ejector plunger 106 to push the stack of cookies out of the discharge apparatus 100, onto the wrapping machine conveyor 102, between the flights 118 thereof. In being discharged, the stack of cookies roll down the sloped support guide plate 104 into a generally V-shaped trough formed by the trough walls 114 and 116, where they are picked up by the flights 118.

The accumulated stacks are dropped out in timed sequence by connecting bars, pivot linkages and the like which are actuated primarily by a pneumatic cylinder. The sequencing of the operation of the pneumatic cylinder is accomplished by a rotating timing cam operating a microswitch which, in turn, energizes a solenoid valve permitting compressed air to actuate the pneumatic cylinder.

One common drive supplies synchronized transmission of motion through a power transmission which includes change gearing to compensate for changes in group count to provide that the wrapper loading mechanism will cycle one time for any given number of cookies in a group being loaded and wrapped.

Accordingly, from the above description, it can be seen that an apparatus for counting and loading items, particularly cookies, is disclosed which includes two drop chute assemblies each of which has an accumulator that is operable to receive a group of cookies from each of two rows of cookies, with each row consisting of a different color or flavor of cookies, and to combine the two groups of cookies into one stack of cookies. The stacks of cookies consisting of like halves of the two color or flavored cookies are dropped from the accumulators into discharge apparatus associated with the respective ones of them, which discharge apparatus is operable to discharge or eject the stacks of cookies onto a wrapping machine conveyor. The operation of the apparatus, as well as the drop chute assemblies and the accumulators thereof, the discharge apparatus and the wrapping machine, obviously are all coordinated and synchronized, so that the entire machine functions as one unit. In this respect, the entire machine can be generally arranged as disclosed in the above-mentioned U.S. Pat. No. 3,290,859, such arrangements being more-or-less conventional and well within the knowledge of those skilled in the art.

In FIG. 17, a timing chart is illustrated and the synchronized and time relationship between the operation of the intermittent conveyor 17, the drop chutes 18-21, the drop chute assemblies 27 and the discharge apparatus 100 can be seen. For example, the line 150 represents the operation of the intermittent conveyor 17, while the drop gates 22 and 24, the accumulator shuttle, the accumulator drop gates comprising the drop rails 56 and 58, and the drop gates of the respective ones of the discharge apparatus are represented by the lines 160, 170, 180, 190 and 200, respectively.

As can be seen, during that portion of the cycle represented by the line 150*a*, the itermittent conveyor 17 advances the groups of cookies into position with respect to the drop chutes 18–21. As can be seen by the line 60*a*, the drop gates 22 and 24 all are closed at this time, and by the line 170*a*, it can be seen that the accumulator shuttle is retracting from the position whereat the stacked groups of cookies are dropped to its receiving position. The line 180*a* indicates that the accumulator's drop gates 56 and 58 are closing, the cookies having been dropped out of the accumulators into the discharge apparatus 100.

During that portion of the cycle represented by the line 150*b*, the motion of the intermittent conveyor 17 stops. The drop gates 22 and 24 start to open (line 160*b*), and the cookies drop into the drop chutes 18 and 19 (line 160*c*). The accumulator shuttle dwells during this time (line 170*b*), as do the drop gates (line 180*b*).

Now, the cookies having dropped through the drop gates 22 and 24, the intermittent conveyor 17 starts its transfer motion, to advance four more groups of cookies (line 150*c*) and, during this time, the drop gates 22 and 24 again close (line 160*d*) and remain closed until the start of a new cycle (line 160*e*). At the time that the drop gates 22 and 24 start to close, the accumulator shuttles start to transfer the one group of cookies to stack them with the other group (line 170*c*). When it reaches its forward advanced position, it dwells there until the start of a new cycle (line 170*d*).

When the accumulator shuttle reaches its advanced position, the accumulators' drop gates 56 and 58 start to open (line 180*c*) and, once opened, they remain open until the start of a new cycle (line 180*d*).

In the discharge apparatus, the drop gates of both initially are closed (lines 190*a* and 200*a*). The drop gate on one of them starts to open (line 190*b*), and then remains open (line 190*c*), after which time it starts to close (line 190*d*). All during this time, the drop gate of the other discharge apparatus is closed (line 200*a*).

Once the drop gate of the first discharge apparatus has closed (line 190*e*), shortly thereafter the drop gate of the other discharge apparatus starts to open (line 200*b*), and then remains open (line 200*c*). It then starts to close (line 200*d*), and then remains closed until the start of a new cycle (200*e*). It will be appreciated that the timing of the wrapping machine is synchronized with that of the discharge apparatus, so that the stacked groups of cookies are delivered to the wrapping machine conveyor such that the groups of cookies are picked up by the flights of the conveyor.

It will thus be seen that the objects set forth above, among those made apparent from the preceding description, are efficiently attained and certain changes may be made in carrying out the above method and in the construction set forth. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. Apparatus for conveying items such as cookies and the like, said items being conveyed in two rows in parallel spaced-apart relation and being of one kind in one of said rows and of another kind in the other one of said rows, said apparatus comprising a counting conveyor means for conveying, counting and separating the items in each of the two rows into spaced aligned groups, a transfer conveyor means forming a continuation of said counter conveyor means, at least a first pair of drop chutes mounted in item receiving relation with respect to said transfer conveyor means, each of said first pair of drop chutes receiving in consecutive fashion one group of items from one of the two rows and one group of items from the other one of the two rows, the outlet of said first pair of drop chutes being in alignment, drop gates forming an item carrying surface of said transfer conveyor means and extending over said first pair of drop chutes and movable laterally to accommodate predetermined ones of said groups of the items in the respective ones of the two rows to drop through said first pair of drop chutes, discharge means for discharging stacked groups of the items to a wrapping machine, and an accumulator means for receiving from the respective ones of the two rows one group of the items dropped through said first pair of drop chutes, for combining said groups of items to form a stacked group of items consisting of half items from one of said rows and half from the other one of said rows, and for delivering said stacked group of items to said discharge means.

2. The apparatus of claim 1, further comprising at least a second pair of said drop chutes, a second one of said accumulator means and a discharge means associated with said second accumulator means, said second pair of said drop chutes being associated with said second accumulator means, said drop gates extending over said second pair of drop chutes and being movable laterally to accomodate one group of items from one of the two rows to drop through one of said second pair of drop chutes and one group of items from the other one of the two rows to drop through the other one of said second pair of drop chutes into said second accumulator means, whereby each of said acummulator means receives therein a group of items from one of the two rows and a group of items from the other one of the two rows.

3. The apparatus of claim 2, wherein said first and second pair of drop gates are operated to simultaneously accommodate said groups of items to drop through said drop chutes into each of said accumulator means.

4. The apparatus of claim 3, wherein both of said accumulator means operate simultaneously to combine said groups of items to form a stacked group of items.

5. The apparatus of claim 4, wherein both of said accumulator means operate simultaneously to deliver said stacked group of items to the discharge means associated with the respective ones of them.

6. The apparatus of claim 1, wherein said accumulator means comprises two sections for receiving therein respectively a group of items from the respective ones of said two rows of items dropped through said first pair at drop chutes, a shuttle assembly for longitudinally advancing the group of items received within one of said sections into substantially longitudinal abutting relation with the group of items received within the other one of said sections to thereby combine the two groups of items to form a stacked group of items consisting of half items from one of the two rows and half items from the other one of the two rows, and a drop gate for dropping said stacked groups of items for delivery to said discharge means.

7. The apparatus of claim 2, wherein each of said accumulator means comprises two sections for receiving therein a group of items from the respective ones of said two rows of items dropped through the respective ones of said first and second pair of drop chutes, a shuttle assembly for longitudinally advancing the group of items received within one of said sections into substantially longitudinal abutting relation with the group of items received within the other one of said sections to thereby combine the two groups of items to form a stacked group of items consisting of half items from one of the two rows and half items from the other one of the two rows, and a drop gate for dropping said stacked groups of items for delivery to said discharge means.

8. The apparatus of claim 7, wherein said two rows of items are located on each of the opposite sides of the centerline of said apparatus, said two sections of each of said accumulator means being longitudinally aligned along the centerline of said apparatus, said first and second pair of drop chutes having sloped guide walls for guiding said groups of items into said sections as said groups of items drop through said first and second pair of drop chutes.

9. The apparatus of claim 8, wherein said first and second pair of drop chutes each further comprise a generally L-shaped guide wall and end walls, said end walls being spaced apart so as to receive and vertically support within each section of said accumulator means a group of items of a predetermined count.

10. The apparatus of claim 9, wherein said shuttle assembly comrises a pair of parallel, spaced-apart slide rods, a pair of slide blocks slidably reciprocally mounted on said pair of slide rods, and a pair of pusher blades affixed to the respective ones of said slide blocks, each of said pair of pusher blades extending respectively into one of said first and second pair of drop chutes and the end walls of said first and second pair of drop chutes being formed to receive them in a fashion such that said pusher blades effectively form a vertical extension of said end walls, said group of items in one of said sections of one of said accumulator means being slidably longitudinally advanced by and between said pairs of pusher blades into longitudinal stacked relationship with said group of items in the other section of said one accumulator means during the operation of said shuttle assembly.

11. The apparatus of claim 10, wherein each of said drop gates of said accumulator means comprises a pair of generally angularly folded guide bars which extend transversely across said accumulator means beneath said two sections thereof so as to form a bottom wall therefor, a pneumatic cylinder, linkage means coupling said pneumatic cylinder and said pair of guide bars and operable upon the operation of said pneumatic cylinder to open and close said guide bars to permit said items to drop from said accumulator means.

12. A drop chute assembly for use in combination with apparatus for conveying such as cookies and the like, said items being conveyed in two rows in parallel spaced-apart relation and being of one kind in one of said rows and of another kind in the other one of said rows, the apparatus including a counting conveyor means for conveying, counting and separating the items in each of the two rows into spaced aligned groups, a transfer conveyor means forming a continuation of said counting conveyor means, a drop gate forming an item carrying surface of said transfer conveyor means, a drop gate forming an item carrying surface of said transfer conveyor means, and discharge means for discharging stacked groups of the items to a wrapping machine, a drop chute assembly comprising a pair of drop chutes mounted in item receiving relation with respect to said transfer conveyor means for receiving therein a group of items from the respective ones of said two rows of items, the outlet of said pair of drop chutes being in alignment, said drop gate extending over said drop chutes and movable laterally to accommodate groups of the items in the respective ones of the two rows to drop into and through said drop chutes, an accumulator means having two sections for receiving from the respective ones of the two rows one group of the items dropped through said drop chutes, a shuttle assembly means for longitudinally advancing the group of items received within one of said sections into substantially longitudinal abutting relation with the group of items received within the other one of said sections to thereby combine the two groups of items from one of the two rows and half items from the other one of the two rows, and a drop gate for dropping said stacked group of items for delivery to said discharge means.

* * * * *